US008133375B2

(12) United States Patent
Huang

(10) Patent No.: US 8,133,375 B2
(45) Date of Patent: Mar. 13, 2012

(54) METHOD OF SURFACE PRINTING AND PLATING

(75) Inventor: Yu-Hwei Huang, Tao-Yuan Hsien (TW)

(73) Assignee: Ho E Screw & Hardware Co., Ltd., Lu-Chu, Taoyuan (TW)

( * ) Notice: Subject to any disclaimer, the term of this patent is extended or adjusted under 35 U.S.C. 154(b) by 394 days.

(21) Appl. No.: 12/131,157

(22) Filed: Jun. 2, 2008

(65) Prior Publication Data

US 2009/0294292 A1 Dec. 3, 2009

(51) Int. Cl.
*C25D 5/02* (2006.01)

(52) U.S. Cl. ..... 205/118; 205/120

(58) Field of Classification Search ..... 205/118, 205/120

See application file for complete search history.

(56) References Cited

U.S. PATENT DOCUMENTS

| | | | | |
|---|---|---|---|---|
| 2,451,340 | A * | 10/1948 | Jernstedt | 205/103 |
| 4,075,064 | A * | 2/1978 | Otsu et al. | 427/287 |
| 5,037,504 | A * | 8/1991 | Takeuchi | 216/40 |
| 6,748,641 | B2 * | 6/2004 | Watanabe et al. | 29/458 |

FOREIGN PATENT DOCUMENTS

| | | | |
|---|---|---|---|
| DK | 2006001056 | A * | 2/2008 |
| JP | 63144071 | A * | 6/1988 |

OTHER PUBLICATIONS

Merriam-Webster's Collegiate Dictionary, Tenth Edition, © no month, 1997, p. 730.*
English Translation of JP 63-144071, pp. 1-13.*

* cited by examiner

*Primary Examiner* — Edna Wong
(74) *Attorney, Agent, or Firm* — Guice Patents PLLC

(57) ABSTRACT

A method of surface printing and electric plating, it is to perform pre-plating to form a pre-plated layer firstly on a surface of a metallic or non-metallic article to be plated, thereby the metallic or non-metallic surface will not be oxidized, and to perform printing and then electric plating to make the plated layer higher than the electric printed layer, thus an effect of 3 dimensions can be resulted; and the printing oil ink is protected in the plated layer, thereby it is not subjected to being stripped off by abrasion.

3 Claims, 3 Drawing Sheets

METHOD OF SURFACE PRINTING AND PLATING

BACKGROUND OF THE INVENTION

1. Field of the Invention

The present invention relates to a method of surface printing and electric plating, and especially to a brand new process of pre-plating to form a pre-plated layer firstly and electric plating secondly performed on a metallic or non-metallic surface.

2. Description of the Prior Art

Doing electric plating work on a metallic article to beautify its surface is a generally used industrial technical means. By virtue that after electric plating, there is only a single color on the surfaces, normally another plated layer is printed with words and drawings to enhance beauty or advertising effect.

Such a conventional method of printing and electric plating is to perform electric plating firstly on a metallic surface and secondly printing with oil ink; the electric printed layer formed is relieved on the electric plated surface, it is subjected to being stripped off just by abrasion of something strange or hard.

In performing the method of electric plating firstly on a metallic surface and secondly printing with oil ink, the metallic surface must be cleansed in advance; during the stage of printing, the metallic surface has been oxidized, this is unable to be aware with eyes, and thereby superiority of the product will be low after electric plating; problems of stripping off the printing oil ink and inferiority of the plated product thus are created even when rust-proof or anti-oxidation agent is applied during the process of electric plating.

And more, in plating for getting an effect of 3 dimensions, for instance, in making breast medals, metallic material is eroded with acid and then is applied with oil ink and then is treated with electric plating. This mode of process can get the effect of 3 dimensions, but it has difficulty in manufacturing on work pieces with strange shapes (such as those made by bending of elastic steel plates) and the effect of 3 dimensions is unable to get.

SUMMARY OF THE INVENTION

In view of the above problems of the conventional method, the inventor of the present invention provides a method of surface printing and electric plating, it is to perform pre-plating to form a pre-plated layer firstly on a metallic or non-metallic surface to be plated, thereby the metallic or non-metallic surface will not be oxidized, and to perform printing and then electric plating to make the electric plated layer higher than the printed layer, thus an effect of 3 dimensions can be resulted, and the printing oil ink is protected in the plated layer, thereby it is not subjected to being stripped off by abrasion.

Material of the metallic pre-plated layer of the present invention can be nickel, half glossy nickel or copper etc.

And more, the method of surface printing and electric plating of the present invention makes work pieces with strange shapes have an effect of 3 dimensions in manufacturing.

The present invention will be apparent in its process flow of manufacturing and effect after reading the detailed description of the preferred embodiment thereof in reference to the accompanying drawings.

DETAILED DESCRIPTION OF THE PREFERRED EMBODIMENT

Figure 1:
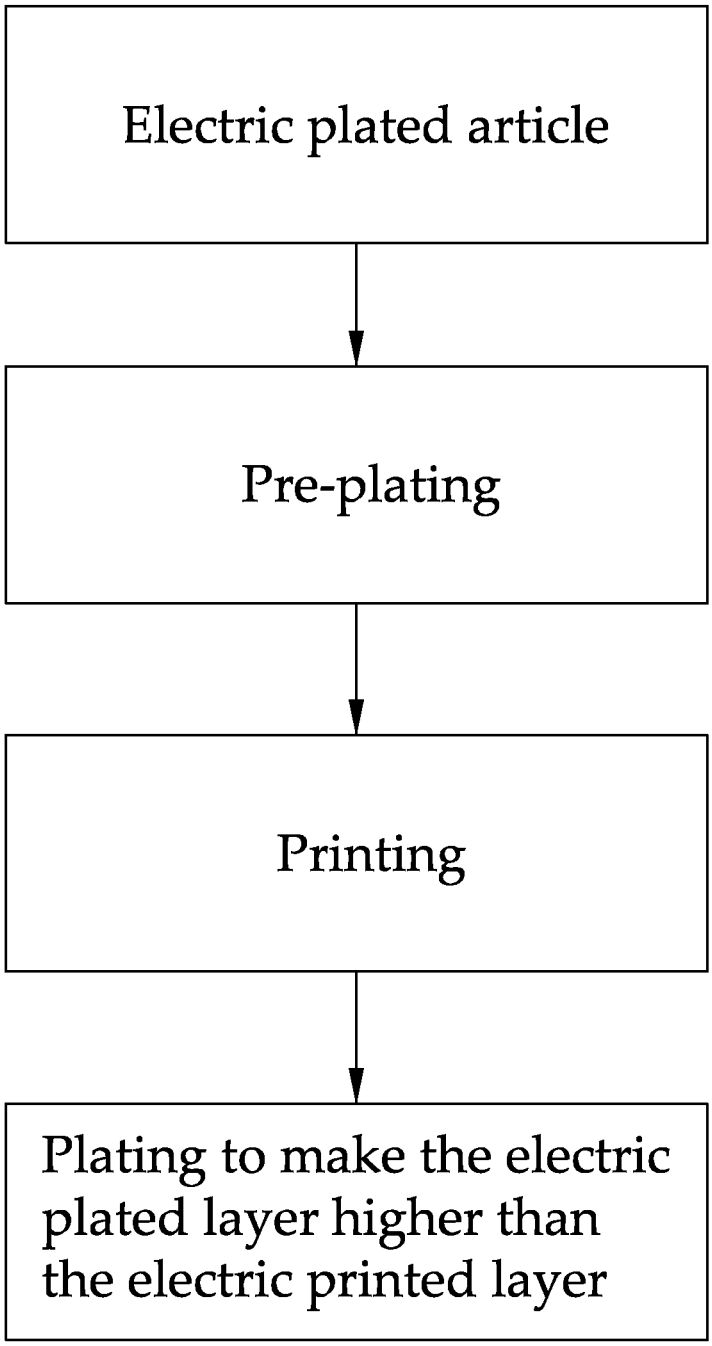
FIG. 1 is a flow chart of the present invention.

Referring to FIG. 1 showing a flow chart of the method of surface printing and electric plating of the present invention, the method includes the following steps:

1. providing an article to be plated, the article is of or non-metallic material;
2. pre-plating, to perform pre-plating to form a metallic pre-plated metallic layer firstly on a surface of an article to be plated, thereby the surface of the article to be plated will not be oxidized, and no acid erosion is required;
3. printing, to print non electric conductive oil ink on a partial surface of the metallic pre-plated layer to form an printed layer;
4. electric plating, to plate metal electrically on the non printed portion of the metallic pre-plated layer to form an electric plated layer, and to make the thickness of the plated layer larger than that of the printed layer.

Material of the metallic pre-plated layer can be nickel, half glossy nickel or copper etc., thereby oxidation of the electric plated metallic or non-metallic material can be prevented. While the electric plated metallic material can be copper or iron etc.

Figure 2:
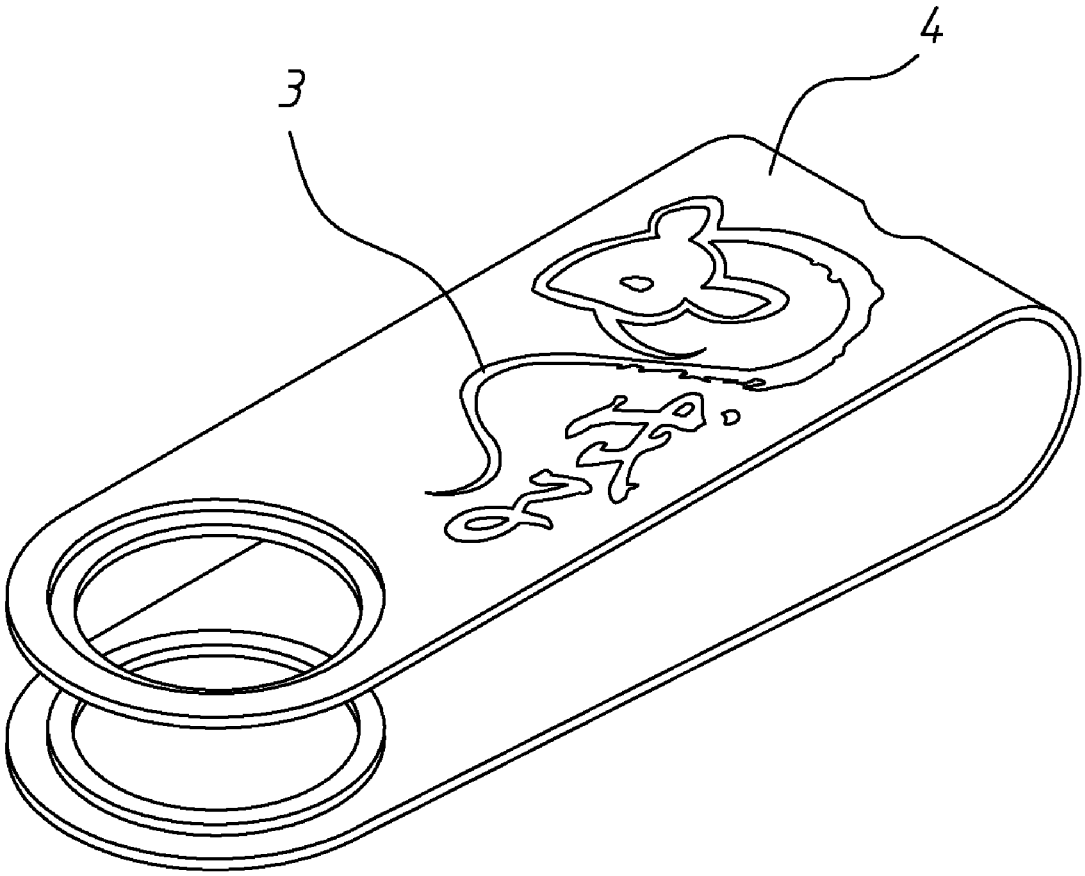
FIG. 2 shows an article made by the method of the present invention.

Referring to FIG. 2 which shows an article with a strange shape made by the method of the present invention; the article is made by bending of elastic steel plates, and is formed on its surface an electric plated layer 4 and an printed layer 3.

Figure 3:
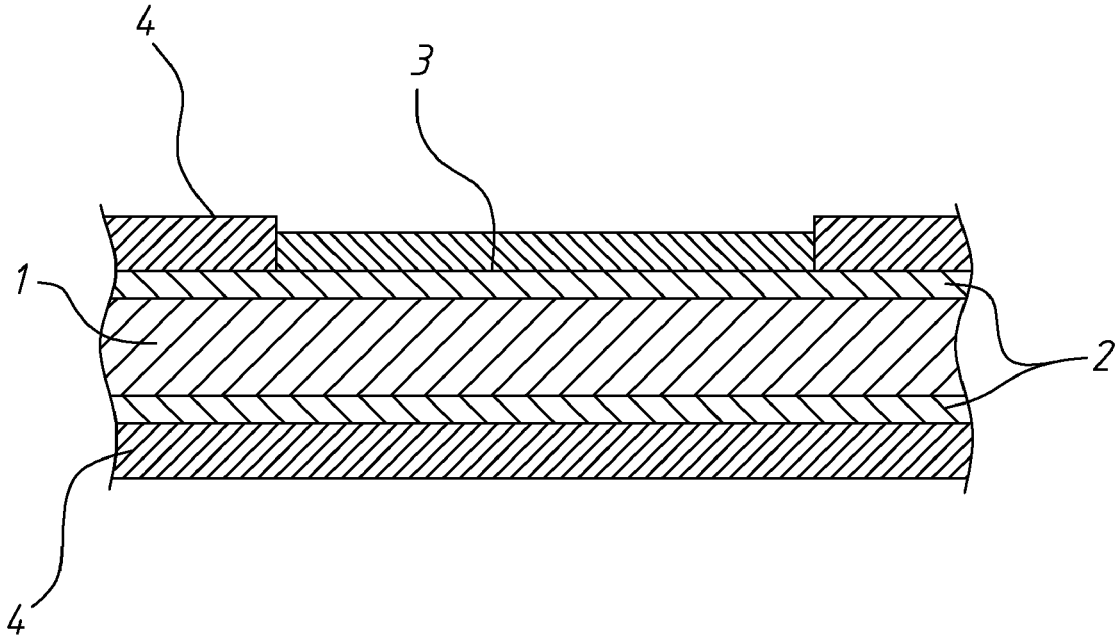
FIG. 3 is an enlarged sectional view showing a part of FIG. 2.
Figure 1:
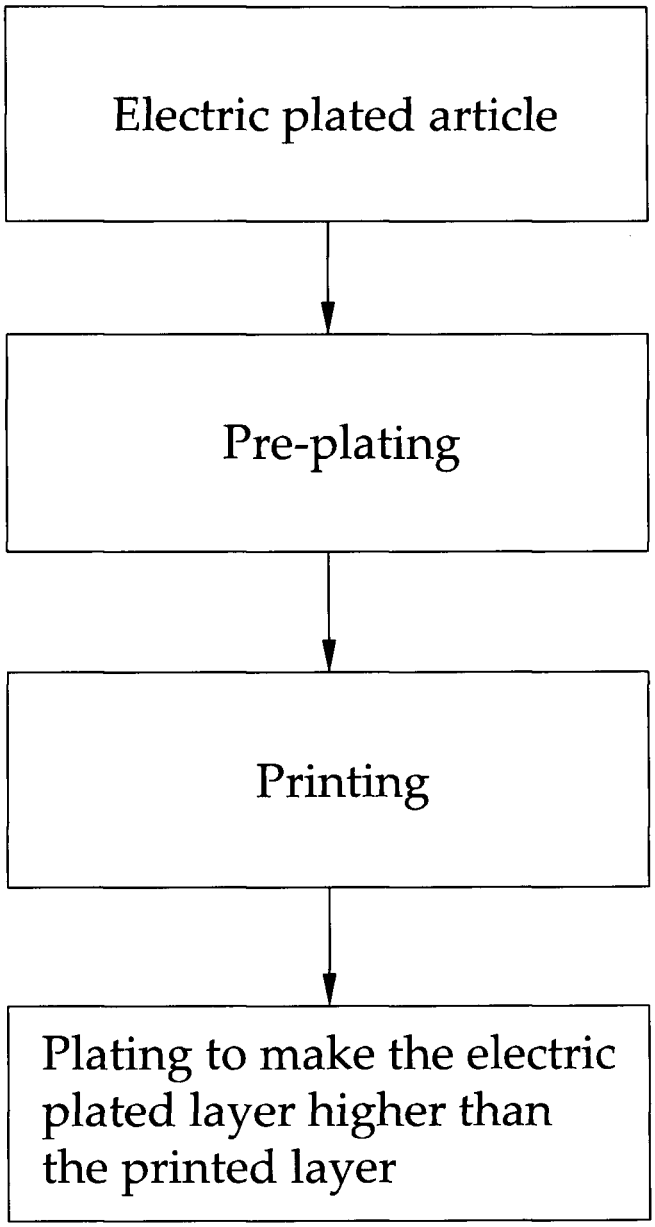

FIG. 3 is an enlarged sectional view showing a part of FIG. 2. wherein a metallic article 1 to be plated has a metallic pre-plated layer 2, a partial surface of the metallic pre-plated layer 2 is printed to form a printed layer 3 firstly, then plating is performed to make the plated layer 4 higher than the electric printed layer 3, now the electric plated surface gets an effect of 3 dimensions of a printed pattern, meantime, by virtue that the electric printed layer 3 with oil ink is protected in the electric plated layer 4, surely it is not subjected to being stripped off by abrasion and thereby is superior over the conventional technique.

In conclusion, according to the description disclosed above, the method of surface printing and electric plating of the present invention contains the essential elements for granting a patent, what I claim as new and desire to be secured by Letters Patent of the United States is:

The invention claimed is:

1. A method of surface printing and electric plating consisting of the steps of:

a) selecting an article made of a metallic material;

b) pre-plating to form a metallic pre-plated layer directly on a surface of the metallic material without oxidizing the surface of the article and without requiring acid erosion;

c) printing an oil ink directly on a first preselected portion of the metallic pre-plated layer to form a printed layer on the first preselected portion of the metallic pre-plated layer, the oil ink being a non electric conductive oil ink, the metallic pre-plated layer is located directly between the metallic material and the oil ink; and d) electrically plating a metal directly on a second preselected portion of the metallic pre-plated layer to form an electric plated layer, the second preselected portion of the metallic pre-plated layer being located adjacent to the first preselected portion of the metallic pre-plated layer, the metal of the electric plated layer being located adjacent to the printed layer and the metal of the electric plated layer having a thickness greater than a thickness of the printed layer;

wherein, in the pre-plating step b), the material of the metallic pre-plated layer is selected from a group consisting of nickel, half glossy nickel, and copper.

2. The method according to claim 1, wherein, in the selecting step a), the metallic material of the article is copper.

3. The method according to claim 1, wherein, in the selecting step a), the metallic material of the article is iron.

* * * * *

UNITED STATES PATENT AND TRADEMARK OFFICE

CERTIFICATE OF CORRECTION

PATENT NO. : 8,133,375 B2
APPLICATION NO. : 12/131157
DATED : March 13, 2012
INVENTOR(S) : Yu-Hwei Huang It is certified that error appears in the above-identified patent and that said Letters Patent is hereby corrected as shown below:

Title Page (57), line 2, insert --metallic-- immediately preceeding "pre-plated layer firstly".

(57), line 6, delete "electric" immediately preceeding "printed layer".

(57), line 8, insert --electric-- immediately preceeding "plated layer, thereby".

Drawing (reproduction of Fig. 1), 4th box (lowest box), line 3, delete "electric" immediately preceeding "printed layer".

In the drawing, Sheet 1, Figure 1, in the 4th box (lowest box), line 3, delete "electric" immediately preceeding "printed layer".

Column 1, line 9, insert --metallic-- immediately preceeding "pre-plated layer".
Column 1, line 21, delete "electric" immediately preceeding "printed layer".
Column 1, line 49, insert --metallic-- immediately preceeding "pre-plated layer firstly".

Column 2, line 18, delete "metallic" immediately preceeding "layer firstly on".
Column 2, line 22-23, delete "an" and insert --a-- immediately preceeding "printed layer".
Column 2, line 36, delete "an" and insert --a-- immediately preceeding "printed layer 3".
Column 2, line 40, insert --electric-- immediately preceeding "plating".
Column 2, line 41, insert --electric-- immediately preceeding "plated layer 4".
Column 2, lines 41-42, delete "electric" immediately preceeding "printed layer 3".
Column 2, line 44, delete "electric" immediately preceeding "printed layer 3".

Signed and Sealed this
Eighth Day of May, 2012

David J. Kappos

David J. Kappos
*Director of the United States Patent and Trademark Office*

(12) United States Patent
Huang

(10) Patent No.: US 8,133,375 B2
(45) Date of Patent: Mar. 13, 2012

(54) METHOD OF SURFACE PRINTING AND PLATING

(75) Inventor: Yu-Hwei Huang, Tao-Yuan Hsien (TW)

(73) Assignee: Ho E Screw & Hardware Co., Ltd., Lu-Chu, Taoyuan (TW)

( * ) Notice: Subject to any disclaimer, the term of this patent is extended or adjusted under 35 U.S.C. 154(b) by 394 days.

(21) Appl. No.: 12/131,157

(22) Filed: Jun. 2, 2008

(65) Prior Publication Data

US 2009/0294292 A1 Dec. 3, 2009

(51) Int. Cl.
*C25D 5/02* (2006.01)

(52) U.S. Cl. ..... 205/118; 205/120

(58) Field of Classification Search ..... 205/118, 205/120

See application file for complete search history.

(56) References Cited

U.S. PATENT DOCUMENTS

| | | | | |
|---|---|---|---|---|
| 2,451,340 A * | 10/1948 | Jernstedt | 205/103 |
| 4,075,064 A * | 2/1978 | Otsu et al. | 427/287 |
| 5,037,504 A * | 8/1991 | Takeuchi | 216/40 |
| 6,748,641 B2 * | 6/2004 | Watanabe et al. | 29/458 |

FOREIGN PATENT DOCUMENTS

| | | |
|---|---|---|
| DK | 2006001056 A * | 2/2008 |
| JP | 63144071 A * | 6/1988 |

OTHER PUBLICATIONS

Merriam-Webster's Collegiate Dictionary, Tenth Edition, © no month, 1997, p. 730.*
English Translation of JP 63-144071, pp. 1-13.*

* cited by examiner

*Primary Examiner* — Edna Wong
(74) *Attorney, Agent, or Firm* — Guice Patents PLLC

(57) ABSTRACT

A method of surface printing and electric plating, it is to perform pre-plating to form a pre-plated layer firstly on a surface of a metallic or non-metallic article to be plated, thereby the metallic or non-metallic surface will not be oxidized, and to perform printing and then electric plating to make the plated layer higher than the electric printed layer, thus an effect of 3 dimensions can be resulted; and the printing oil ink is protected in the plated layer, thereby it is not subjected to being stripped off by abrasion.

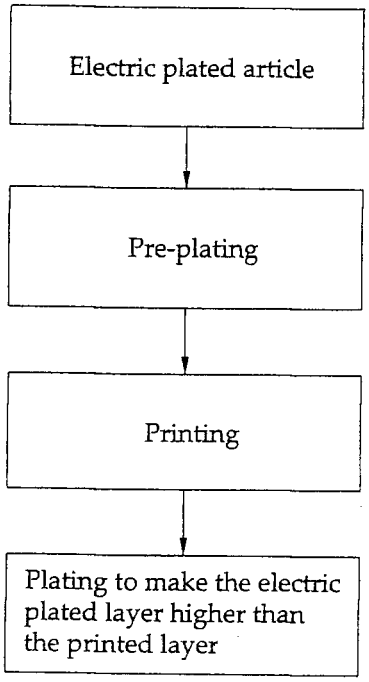

3 Claims, 3 Drawing Sheets